US005620056A

United States Patent [19]

Eppink

[11] Patent Number: 5,620,056

[45] Date of Patent: Apr. 15, 1997

[54] COUPLING FOR A DOWNHOLE TANDEM DRILLING MOTOR

[75] Inventor: Jay M. Eppink, Spring, Tex.

[73] Assignee: Halliburton Company, Dallas, Tex.

[21] Appl. No.: 476,972

[22] Filed: Jun. 7, 1995

[51] Int. Cl.[6] ..... E21B 3/00

[52] U.S. Cl. ..... 175/95; 175/107

[58] Field of Search ..... 175/95, 107; 418/48; 285/177

[56] References Cited

U.S. PATENT DOCUMENTS

| | | | |
|---|---|---|---|
| 3,802,803 | 4/1974 | Bogdanov et al. | 418/48 X |
| 3,982,858 | 9/1976 | Tschirky | 418/48 |
| 4,059,165 | 11/1977 | Clark | 175/107 |
| 4,585,401 | 4/1986 | Baldenko et al. | 418/5 |
| 4,679,638 | 7/1987 | Eppink | 175/107 |
| 4,711,006 | 12/1987 | Baldenko et al. | 29/156 |
| 5,090,497 | 2/1992 | Beimgraben et al. | 175/107 |

FOREIGN PATENT DOCUMENTS

| | | | |
|---|---|---|---|
| 2441837 | 3/1975 | Germany | 175/107 |
| 2084697 | 4/1982 | United Kingdom . | |

*Primary Examiner*—William P. Neuder
*Attorney, Agent, or Firm*—Conley, Rose & Tayon, P.C.

[57] ABSTRACT

The tandem drilling motor includes an upper power section comprised of an upper rotor and stator and a lower power section comprised of a lower rotor and stator. A connector having a flowbore therethrough has one end attached to one end of the upper rotor and another end connected to an end of the lower rotor. The upper and lower rotors have a bore therethrough for the passage of drilling fluid. The flowbore of the connector communicates with the bores of the upper and lower rotor whereby drilling fluid may pass through the bore of the upper rotor, the flowbore of the connector, and the bore of the lower rotor. The drilling fluid exits the lower rotor through a port adjacent its lower end. The connector includes transition bores at each end to avoid turbulent flow through the connector.

15 Claims, 2 Drawing Sheets

COUPLING FOR A DOWNHOLE TANDEM DRILLING MOTOR

BACKGROUND OF THE INVENTION

1. Field of the Invention

The present invention relates generally to downhole tandem drilling motors of the progressive cavity type and, particularly, to a flexible coupling for connecting the upper and lower rotors and stators of the downhole tandem motor.

2. Description of Related Art

Downhole drilling motors are used in the drilling of oil and gas wells. In the usual mode of operation, the power output shaft of the motor is connected to a drilling tool such as a drill bit which then rotates with respect to the housing of the motor. The housing, in turn, is connected to a conventional drill string composed of drill collars and sections of drill pipe. This drill string extends to the surface where it is connected to a kelly mounted to the rotary table of a drilling rig. Drilling fluid is pumped down through the drill string to the bottom of the hole and back up the annulus between the drill string and the wall of the borehole. The drilling fluid cools the drilling tool and removes the cuttings resulting from the drilling operation. The drilling fluid also provides the hydraulic power to operate the motor.

Downhole drilling motors of the progressive cavity type are well known in the art. Such a motor includes a helicoidal rotor and a complimentary helicoidal stator forming a power section. The housing of the stator typically includes a conduit made of steel and a helically grooved elastic lining bonded to the inner wall of the conduit forming rubber lobes. The rotor is also typically made of steel with chrome plating and is disposed inside the stator. The rotor likewise is provided with helical grooves on its outer surface, the number of rotor grooves typically being one less than the number of stator grooves. The rotor includes a central passageway therethrough for the passage of fluid with the lower end of the rotor bring connected to an output shaft. The helical grooves of the stator and rotor form cavities of slightly variable volume for the passage of fluid therethrough. The working fluid is forced to flow between the stator and rotor so as to fill the cavities and act on the helical grooves of the rotor causing the rotor to rotate within the stator as the cavities move down the length of contact between the rotor and stator.

As the helical rotor rotates in an eccentric fashion, the rotor gyrates and rotates within the stator at a distance from the stator center line in the reverse direction relative to its rotation. A universal connection is used to connect the gyrating rotor to the non-gyrating output shaft and translate this gyrating motion into true rotational motion. A typical universal connection includes a pair of universal sections which connect a straight rod to the rotor and to the output shaft. The universal sections are designed to take only torsional load and have a ball and race assembly to take thrust load. Rubber boots may be clamped over the universal sections to keep out drilling fluid.

Since the drilling fluid for drilling the borehole serves both the function of cooling the drill bit and removing the cuttings as well as operating the downhole motor, it is necessary to have proper fluid flow to both the bit and through the motor. For this purpose, a nozzle is typically placed at the top of the rotor to regulate the flow and apportion the flow between the central passageway in the rotor and the flow path between the rotor and stator. There is also a nozzle in the lower end of the rotor to allow the flow through the central passageway of the rotor to combine with the flow between the rotor and stator prior to passing through the nozzles of the drill bit. Where it is desirable to increase the flow through the drill bit to allow greater cleaning of the bit due to the accumulation of cuttings, the size of the nozzle at the top of the rotor is changed to adjust that part of the flow through the power section so that the preferred flow rate can be maintained through the power section of the motor.

The speed of the motor is determined by the ratio of the gallons of fluid per minute (GPM) which flow through the motor to the revolutions per minute (RPM) of the drill bit. A predetermined fluid volumetric velocity (GPM) and pressure at the bit nozzles is required so that the cuttings may be moved through the annulus to the surface. Further, the torque of the motor is proportional to the pressure drop across the stator. As the fluid passes through each stage of the power section, the fluid pressure is reduced. This pressure drop is required to add resistance to the flow to convert into torque to rotate the rotor. These considerations influence the minimum pressure drop which can be tolerated and still obtain the necessary fluid velocities and pressures at the bit nozzles.

The rubber of the stator frequently fails due to the eccentric motion of the rotor and the magnitude of the pressure drop across the motor if the motor delivers a substantial torque or if there is too much flow through the power section. The resultant hysteresis in the rubber deleteriously affects the properties of the rubber. Further, if the rotor spins too fast, the centrifugal force of the rotor causes it to bow outwardly and tear the rubber on the stator. The result is a loss of portions of the rubber which break away from the body of the stator, called "chunking," and may strip the rubber away from the metal housing due to bond failure.

The length of the complimentary surface areas between the upper rotor-stator power section and lower rotor-stator power section has a direct effect on the power output of the motor. Thus, by lengthening the power section, the torque of the motor is increased. See for example, U.S. Pat. No. 5,090,497. Although lengthening the power section achieves more power, there are manufacturing and assembly problems in making the power section longer. The molding of the rubber to produce a successful bond to the stator housing and the necessary helical configuration at its surface become more difficult as the diameter or length of the stator increase. Another difficulty is holding the stator rubber in a long tube and keeping the rubber centralized. Another problem is the length and flexibility of the stator in smaller motors. Also, as flexibility is increased, the manufacture of the elongated power section parts becomes more expensive and less reliable.

One means of obtaining more power and avoiding a lengthy rotor and stator is the use of a tandem motor which includes an upper power section and a lower power section. U.S. Pat. Nos. 3,982,858; 4,585,401; and 4,711,006 disclose tandem motors. In a tandem motor, the upper and lower rotors and stators are connected. The rotors are connected together by constant velocity joints that allow free radial movement and/or offset and/or bending between the two attached rotors. Constant velocity joints are similar to the universal joints previously described where there is no side load. The stators are connected by a spacer housing.

In the prior art tandem motors, the fluid must bypass and flow around the constant velocity joint. There is no room in the interior diameter of the constant velocity joint to have a flow passage. Flowing the fluid around the joint does not work well in a high flow motor because it is necessary to have a nozzle at the upper end and ports at the lower end of the upper rotor and another nozzle at the upper end of the lower rotor to allow the flow to bypass and flow around the joint. The flow from the surface passes out the ports in the lower end of the upper rotor, through the annulus between the connecting rod and the spacer housing, and then flows through the nozzle in the upper end of the lower rotor.

A solid connecting rod may be used between the upper and lower power sections in place of the constant velocity joint. However, the nozzle of the upper rotor and the nozzle back of the lower rotor must be properly sized. Problems can occur if the nozzles are not sized properly. Each nozzle is sized for a given flow rate for the working pressure of that power section. If the nozzle in the upper rotor is sized to have a lesser flow rate than the nozzle in the lower rotor, it will cause an increased flow rate through the upper power section, that will cause an increased pressure drop and flow rate through the upper power section that can be detrimental as described earlier. Generally, the upper nozzle must be slightly smaller than the lower nozzle because oftentimes the upper power section is shorter than the lower power section. For example, in medium speed motors, the upper power section is typically about one half the length of the lower power section. When the upper power section is half the length of the lower power section, the pressure drop across the upper power section is about half that of the lower power section.

Tandem downhole drilling motors are often used to drill deviated wells or horizontal wells. Such a motor is often referred to in the industry as a steerable motor. A steerable motor and bottom hole assembly is described in U.S. Pat. No. Re. 33,751 dated Nov. 26, 1991 to Geczy. A steerable drilling motor typically includes a bent housing located below the lower power section and the motor is steered in the desired direction by alternately rotating the motor housings to achieve the desired hole curvature.

Whenever the motor is rotated in a curved section of the borehole, or whenever it is reoriented in a straight section of the borehole, there is an interference between the motor housing and the borehole causing the motor to flex or bend due to the side loads caused by the borehole. The bend of the motor housing may be so large that there is difficulty getting the motor in and out of the borehole. Thus, the stator housing and rotor must bend along with their working surface profiles. The stator housing and rotor are made of steel or some other stiff material and thus excessive loads are placed on the rotor and stator at the ends and near the middle of the power section.

With the more recent downhole motors being designed with increased torque capacity, more length and more stages of the power section are added to the motor. This added length subjects the motor housings to additional flexing and is more difficult to steer. The flexing causes additional side loads to be applied between the rotor and stator rubber. Also, as a result of the higher penetration rates, cuttings from the bit accumulate faster than previously and require higher flow rates through the motor and up the annulus to float the cuttings to the surface and out of the hole quickly enough to prevent a build up of cuttings that may cause the drill string and motor to get stuck in the hole and/or slow down the rate of penetration. The power section is limited to a maximum flow rate before fluid velocities become large enough to destroy the stator rubber and wash out the power section.

One prior art method of providing the necessary flexibility between the power sections of a tandem motor is the use of a titanium rod as the connecting rod between the upper and lower rotors. Each end of the titanium rod is shrink fitted into the mating ends of the upper and lower rotors. The titanium rod flexes upon the application of a side load to the tandem motor and thus allows a limited side load providing flexibility in the steerable tandem motor. The titanium rod, however, is a solid rod and still requires that the fluid bypass and flow around the titanium rod between the upper and lower rotors. It is very costly to put a central passageway through a titanium connecting rod. Further, there is insufficient room within the spacer housing to provide an adequate shrink fit between the titanium connecting rod and the upper and lower rotors. The shrink fits on the end of the titanium connecting rod tend to come loose and not transmit the required torque between the upper and lower motors. Occasionally, the titanium connecting rod slips or breaks.

One of the problems with using the titanium connecting rod is that the tandem motor must be disassembled to change out a worn out rotor power section. The shrink fit connections between the ends of the titanium rod and the upper and lower rotors become loose from disassembly and assembly.

The present invention overcomes the deficiencies of the prior art.

SUMMARY OF THE INVENTION

The present invention includes a flexible connecting rod that connects the ends of the two rotor power sections to provide flexibility between those power sections. This flexible rod is hollow so that only one nozzle is required at the top of the upper rotor to allow the fluid to bypass in high flow rate applications and the diverted fluid passes through all rotor power sections and back outside the bottom rotor. The rod can be attached to the rotors in any of several means including rotary shouldered threaded connections and shrink fits. The rods can be flexible enough so that the power rotor sections above and below the rod do not need to be timed with the stator above and below the rod because side loads will not be adversely changed. The rod can be flexible enough so that the housing directly around the rod can bend at an angle of 3° or less without excessive side loads between the rotor and stator power sections, for example, with use with double bend motors or higher rates of angle building capability.

The advantage of the present invention over the prior art which is either an articulated or flexible connecting rod that has no flow passage for fluid diversion, is that only one restrictor nozzle is required for the diverted fluid. Standard practice requires a nozzle in the top rotor and bypass holes to divert the fluid back outside the rotor and around the connecting rod and then back into another nozzle in the lower rotor along with bypass holes at the bottom end to divert fluid back outside the rotor and around the lower connecting rod. The nozzles must be carefully matched and sized so that flow rates across the upper and lower power sections are closely matched to prevent excessive pressure drop and short stator rubber life from one of the power sections. These disadvantages are overcome by the connecting rod of the present invention which includes a flowbore for the passage of drilling fluids.

A plurality of power section rotors can be attached in series using the flexible connecting rod of the present invention. Only one nozzle is required on the uppermost rotor power section. This configuration provides even more powerful motors.

Other objects and advantages of the present invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1A:
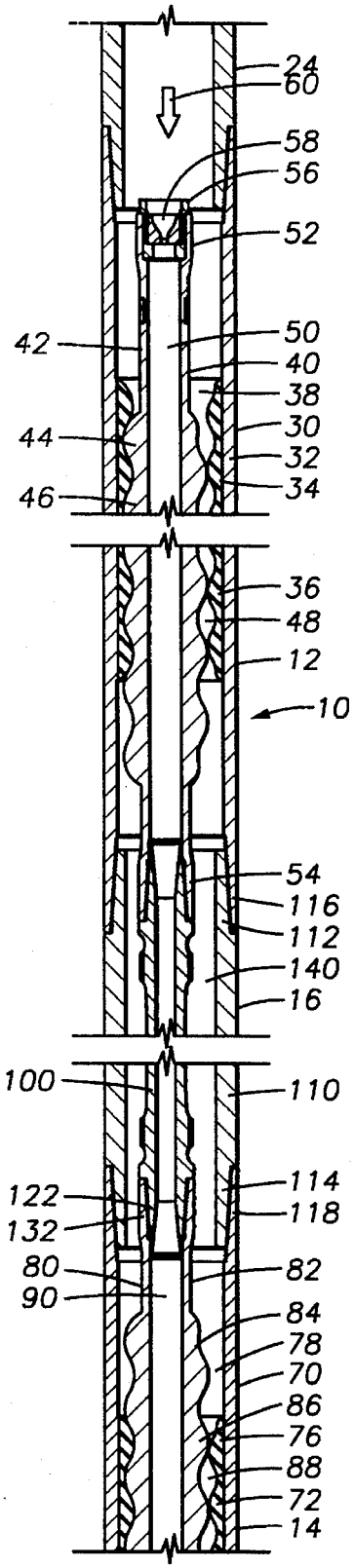
FIGS. 1A and B are an elevation view in cross-section of the downhole tandem drilling motor of the present invention.
Figure 1B:
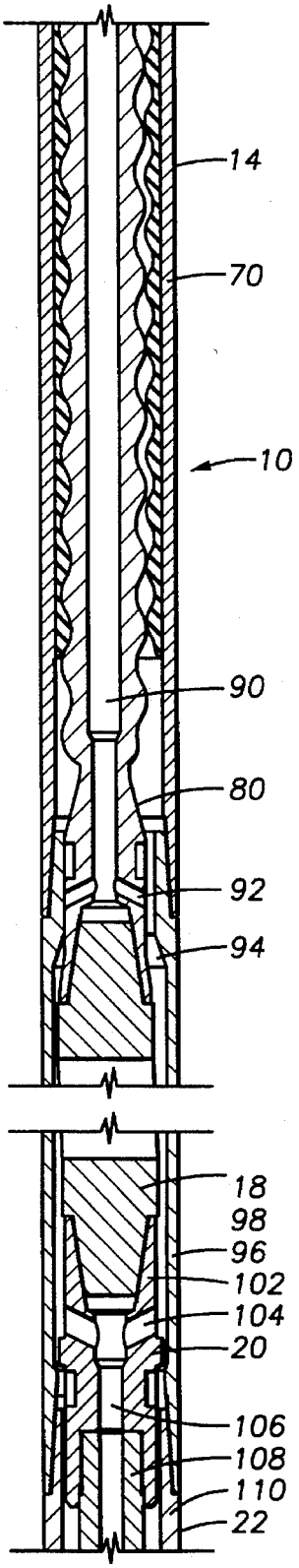

Referring initially to FIGS. 1A and 1B, there is shown a downhole tandem drilling motor 10 having an upper rotor-stator power section 12 and a lower rotor-stator power section 14. An upper connecting assembly 16 connects the upper rotor-stator power section 12 to the lower rotor-stator power section 14. A lower connecting assembly 18 connects lower rotor-stator power housing 14 to a driveshaft cap 20 and a bearing pack assembly 22. The bearing pack assembly 22 is connected at its lower end to a drill bit assembly (not shown) including a drill bit for boring the borehole of the well. A dump valve housing 24 is connected to the upper end of the upper rotor-stator power section 12.

The upper rotor-stator power section 12 includes an upper stator 30 and an upper rotor 40. Stator 30 includes a tubular housing 32 typically made of steel and has an elastic lining 34 bonded to the inner circumferential surface of tubular housing 32. The elastic lining 34 is preferably of an elastomeric material such as a hard rubber composite well known in the art. The elastic lining 34 includes a plurality of spiraling grooves 36 forming rubber lobes. The rotor 40 includes a tubular member 42 of a smaller diameter, typically made of steel with chrome plating and having helical grooves 46 on its outer surface. Generally, there is one more helical groove in the stator than in the rotor. Upon assembly of the rotor 40 within the stator 30, the grooves 36 and 46 form cavities 48 making up a flow path 38 through upper power section 12. The tubular housing 42 of rotor 40 has a bore 50 extending from its upper end 52 to its lower end 54. A nozzle assembly 56 is attached to the upper end 52 of rotor 40 and includes an orifice 58 for apportioning the fluid flow shown by arrow 60 between bore 50 of upper rotor 40 and flow path 38 between upper rotor 40 and upper stator 30.

The lower rotor-stator power section 14 includes a lower stator 70 and a lower rotor 80. Lower stator 70 is substantially the same as upper stator 30 in that lower stator 70 includes a tubular housing 72 having an elastic lining forming helical grooves 76. The lower rotor 80 likewise is similar to upper rotor 40 in that lower rotor 80 includes a tubular housing 82 having helical grooves 84 such that there is formed a fluid path 78 which extends between grooves 76 and 84. Lower rotor 80 also includes a flow bore 90 for the passage of fluid 60 therethrough. As distinguished from upper rotor 40, lower rotor 80 includes a plurality of ports 92 allowing the flow of fluids 60 through flow bore 90 to flow into the outer annular passageway 94 through lower connecting assembly 18.

Lower connecting assembly 18 includes a connecting housing 96 and a connecting rod 98. Connecting rod 98 is a typical universal connection used on the lower end of downhole drilling motors. The upper end of connecting rod 98 is connected to the lower end of lower rotor 80 and the lower end of connecting rod 98 is connected to driveshaft cap 20. Driveshaft cap 20 includes ports 104 allowing fluid flow through a central bore 106 in driveshaft cap 20. The bearing pack assembly 22 includes a bearing pack driveshaft 108 connected to the lower end of driveshaft cap 20 and a bearing pack housing 110 connected to the lower end of connecting rod housing 96.

Figure 2:
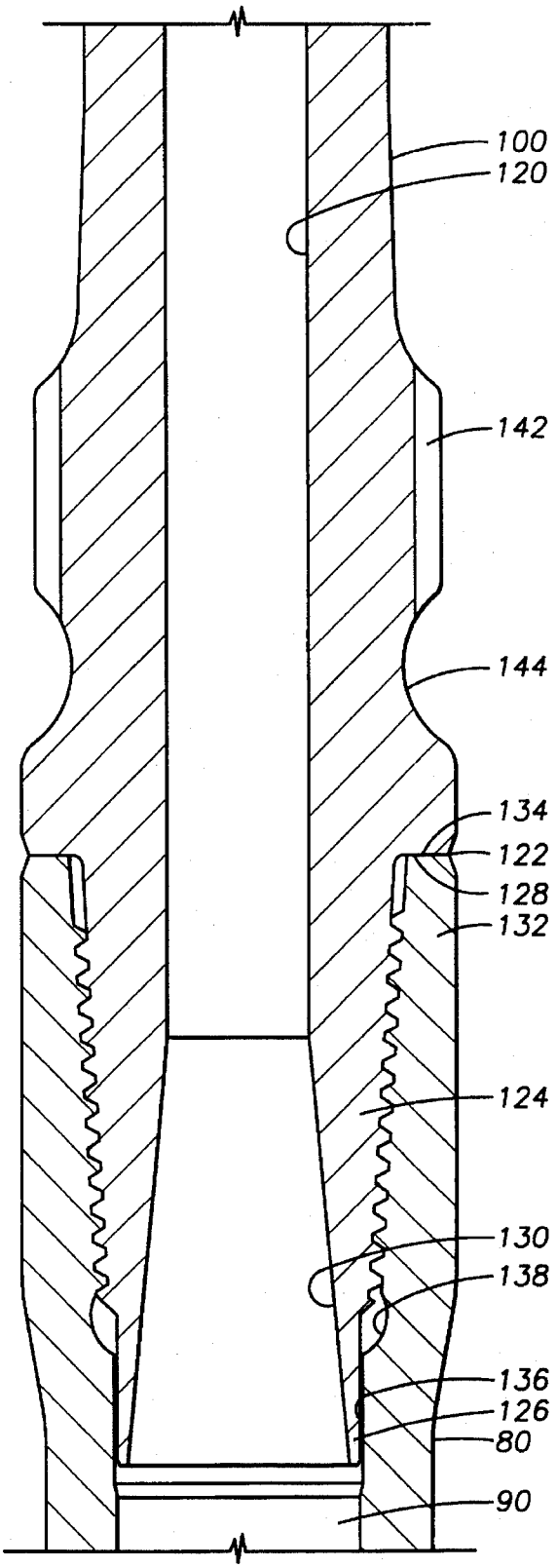
FIG. 2 is a elevation view in cross-section of a portion of the rotor and connecting rod shown in FIG. 1.

Referring now to FIGS. 1A and 2, the upper connecting assembly 16 includes a tubular stator spacer housing 110 and a connecting torsion rod 100. Stator spacer housing 110 includes pin members 112, 114 at each end for threadingly engaging the threaded box 116 on the lower end of upper stator 30 and the threaded box 118 on the upper end of lower stator 70.

Connecting rod 110 is symmetrical such that a description of its lower end shown in FIG. 2 will likewise be a description of its upper end. By having each end of connecting rod 100 identical, there need be no concern about the orientation of the connecting rod 100 between the rotors 40, 80. Further, a symmetrical connecting rod 100 simplifies its design. Referring now to FIG. 2, connecting rod 100 includes a rotary shouldered connection 122 at each end between connecting rod 100 and upper rotor 40 and lower rotor 80. The connecting rod 100 is tubular in that it includes a flow bore 120 throughout its entire length. Flow bore 120, upon the make up of rotary shoulder connections 122, is in fluid communication with bore 50 of upper rotor 40 and bore 90 of lower rotor 80 such that fluid 60 may flow from bore 50 to bore 90 via bore 120 and connecting rod 100. It should be appreciated that attachment means other than rotary shouldered connections may be used, such as a shrink fit.

Preferably, connecting rod 100 is made of a material which will withstand high stress applications and can be exposed to harsh environments such as chlorides. For example, connecting rod 100 may be made of stainless steel or 4330 steel.

It is preferable that connecting rod 100 be as short as possible and yet withstand the stresses placed on the rod. The connecting rod 100 must have sufficient flexibility to withstand the side loads which may be placed on the downhole tandem drilling motor 10. It is preferred that connecting rod 100 have sufficient flexibility to allow the spacer housing 110 to bend at an angle of up to 3° without excessive side loads. Although connecting rod 100 might be made of more exotic metals such as titanium which is more flexible than steel, boring a central passageway through titanium is very expensive. Further, it is very expensive to thread titanium rods.

The rotary shouldered connection 122 at the ends of connecting rod 100 include a threaded pin 124 with the threaded pin 124 including a tapered nose 126. The pin 124 includes an axially facing annular shoulder 128. The upper end of lower rotor 80 includes a threaded box 132 having an upwardly facing annular terminal end 134 for abuttingly engaging the downwardly facing annular shoulder 128 on pin 124. In a rotary shoulder connection, a load is placed between the terminal end 134 and the shoulder 128 such that upon the tightening of the threads, there is also a load placed between the shoulder and the threads. The design strength of the rotary shoulder connection 122 is along the length of the pin and box threads. The box 132 at the upper end of lower rotor 80 has a slightly increased outside diameter and is larger than the minor diameter of rotor 80. Box 132 also includes a tapered receiving bore 136 for receiving the nose 126 of pin 124. There is a small undercut around the circumference of the nose 126 at 136 to provide a sliding fit of the nose 126 into the flow bore 90 of lower rotor 80. It is preferred that the nose 126 fits within the flow bore 90 relatively tightly so that fluid cannot flow between the nose 126 and rotor 80. At the end of the threaded connection of the pin 124 where there is loading, there is a change in cross section that is unsupported and fatigue cracking can occur from rotating bending. Therefore, a relief 138 is provided, forming a uniform radius, for the bending stresses at the end of the threaded connection.

Figure 3:
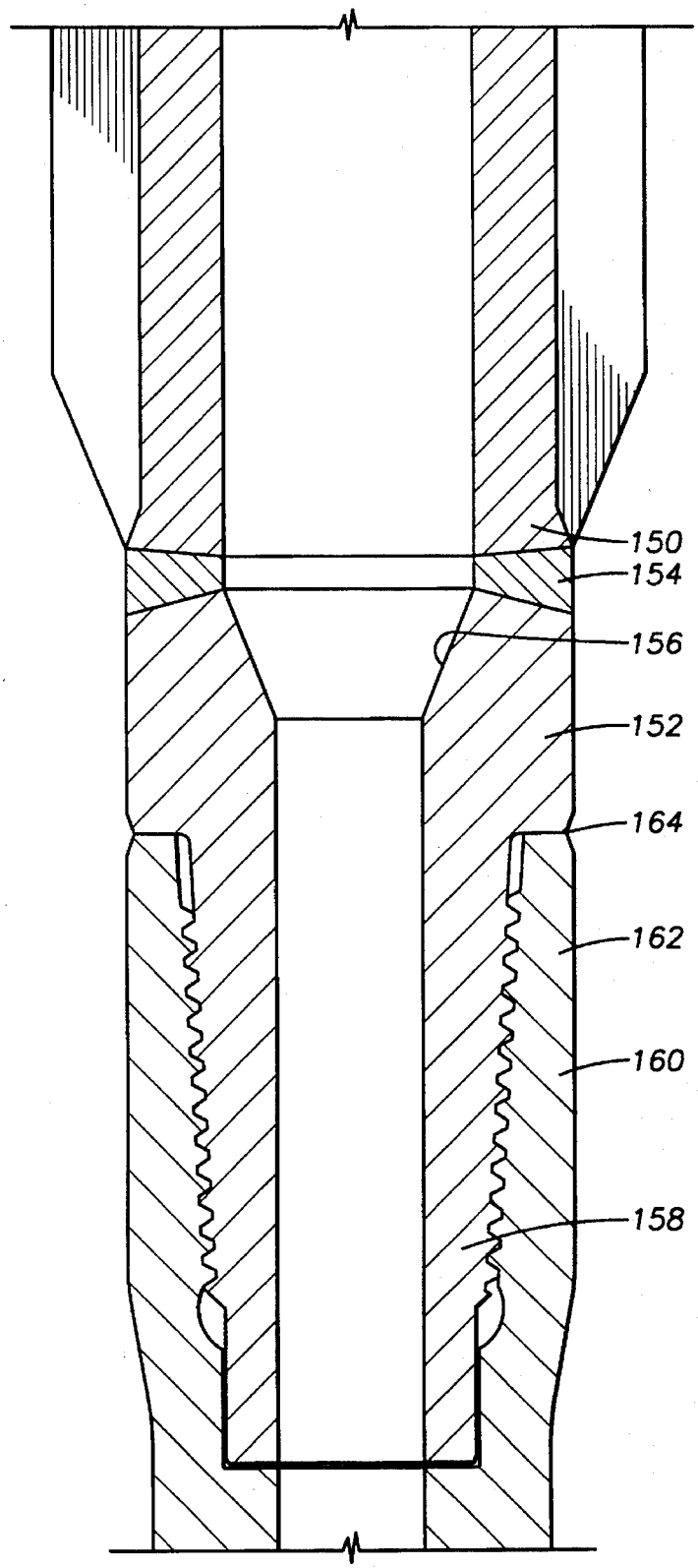
FIG. 3 is an elevation view in cross-section of an alternative embodiment of the rotor and connecting rod shown in FIG. 2.

Referring now to FIG. 3, there is shown an alternative embodiment of the rotary shouldered connection between the ends of the connecting rod and the rotor. The rotor 150 may include a pin end 152 attached to rotor 150 for example as by welding at 154. The pin end 152 may be made of a material which is stronger than that of the rotor 150. The pin end 152 may include a transition bore 156 similar to transition bore 136 hereinafter described. The connecting rod 160 includes a box end 162 for mating engagement with pin 158 on the pin end 152. Pin end 152 and box end 162 form a rotary shouldered connection 164 which is otherwise the same as rotary shouldered connection 122 previously described.

Referring again to FIG. 2, tong flats 142 are disposed on the outer surface of connecting rod 100 adjacent each pin end 124 to facilitate the rotation of connecting rod 100 for connection with upper and lower rotors 40, 80. A radius or relief 144 is provided around the outer circumferences of connecting rod 100 between tong flats 142 and shoulder 134 to reduce stress risers.

In order to have maximum strength in the connecting rod 100, it is preferred that the inside diameter of flow passage 120 through rod 100 be minimized. The smaller diameter flow bore 120 adds cross sectional strength in connecting rod 100. Thus, the flow bores 50, 90 through rotors 40, 80 have a larger diameter than the diameter of flow bore 120 through connecting rod 100. Likewise, it is preferred that the outside diameter of the connecting rod 100 be minimized so that there is more flexibility of the rod 100. However, any increase in the outside diameter of the connecting rod 100 to add strength will increase the stiffness of rod 100 and add length.

The smaller diameter flow passage 120 through connecting rod 100 causes the flow of fluid 60 through flow bore 120 to have a higher velocity than through flow bores 50, 90. Since a change in cross section may cause turbulent flow, it is preferred that the change in cross section be as gradual as possible. Transition bores 130 are provided in the pin 124 at each end of connecting rod 100 to prevent turbulence. Transition bore 130 is cone shaped with a taper of 15° or less. Its length is sufficiently long to prevent any turbulence as the fluid flows from the larger diameter bores 50, 90 to the smaller diameter flow bore 120. Thus, the nose 126 of pin 124 was extended into the transition bore 136 of flow bores 50, 90 to provide a transition to fluid flow thereby preventing turbulence. This allows rod 100 to be as flexible as possible but yet maintain strength by minimizing the inside diameter of the flow passage 120. It is also necessary that there be less than a certain maximum flow velocity through the flow bore 120 to avoid any restriction in flow. These parameters are designed for each size of motor.

In assembly, the drive train including the upper rotor 40, connecting rod 100, lower rotor 80, lower connecting rod 98 and bearing pack driveshaft 20 are inserted into the assembled housings including upper stator housing 30, stator spacing housing 110, lower stator housing 72, and lower connector housing 96. The upsets on the drive train deform the rubber lobes on upper stator 30 and lower stator 70. However, all of the curves and radiuses on the power train are smooth so that the rubber lobes are not cut or tom during assembly. For example, the radius or reliefs 144 adjacent flats 142 cause the rubber lobes to give gradually upon engaging surfaces 144.

During operation, the downhole tandem drilling motor 10 is powered by drilling fluid 60 which is pumped down the drill string (not shown) and into the upper end of upper rotor-stator power section 12. The nozzle assembly 56 apportions the fluid flow between the flow through upper bore 50, flow bore 120, and lower bore 90 and flow through annular upper flow path 38, annular space 140, and lower flow path 78. As the drilling fluid 60 passes through upper rotor-stator power section 12 and lower rotor-stator power section 14, the upper rotor 40 and lower rotor 80 rotate and gyrate within upper and lower stators 30, 70, respectively. That portion of the fluid flow passing through the bores 50,90 of rotors 40, 80 will exit through ports 92 in the lower end of lower rotor 80. This allows fluid flow around lower connecting rod 98 whereby a portion of the flow passes through ports 104 and into flow bore 106 of the driveshaft cap 20 and bearing pack driveshaft 108.

When the motor 10 binds in a deviated borehole, the stator housing 110 bends and the force passes through the stator rubber causing the rubber stator to take up the load and bend and give with the borehole. The rotor is stiffer than the rubber stator. The connecting rod 100 must not only rotate, but flex to accommodate the lateral orbiting motion of upper rotor 40 within upper stator 30 as the drilling fluid 60 passes through cavities 48 between rotor 40 and stator 30. By placing the connecting rod 100 between the upper and lower power sections, flexibility is added so that if the stator bends, the rotor can bend with it. The connecting rod 100 reduces the load on the rubber due to the connecting rod 100 flexing with the flexing of the stator housings 30, 70.

Previously, to adjust the size of nozzle assembly 56 and a second nozzle at the upper end of the lower rotor to thereby regulate flow thorough rotors 40 and 80, it was necessary to disassemble the entire motor. By having only one nozzle assembly 56, it may be replaced with another size nozzle by disconnecting only the upper stator 30 and housing 24. This is a particular advantage in remote locations such as on an offshore drilling rig.

The ability to pass drilling fluid through the motor 10, thereby bypassing the normal path between the rotors and stators is of great advantage in those instances when it is desired to cause large quantities of drilling fluid to flow through the drill bit without letting the same amount of fluid flow pass the rotor-stator power-producing surfaces. This arrangement will allow greater control over the speed of the motor and in turn the drill bit while still permitting large quantities of drilling fluid to flow through the drill bit.

Those skilled in the art will appreciate the various adaptations and modifications of the described preferred embodiment can be configured without departing from the scope and spirit of the invention. Therefore, it is to be understood, that within the scope of the appended claims, the invention may be practiced other than as specifically described herein.

I claim:

1. A coupling for connecting adjacent hollow rotors rotatably mounted within adjacent stators of a drilling motor, the rotors and stators forming an annular area, comprising:

a member having a flowbore therethrough for the passage of drilling fluid; and said member being adapted for connection to one end of each of the hollow rotors to form a common fluid passageway through said member and the hollow rotors whereby drilling fluid may flow through the common fluid passageway and through the annular area.

2. The coupling of claim 1 wherein said member includes ends having threads for establishing a rotary shouldered connection with the rotors.

3. The coupling of claim 2 wherein said ends are threaded boxes.

4. The coupling of claim 2 wherein one end is a threaded pin and the other end is a threaded box.

5. The coupling of claim 2 wherein said member includes a threaded pin on each end with an annular shoulder for threadingly engaging the rotors.

6. The coupling of claim 1 with the rotors having a bore therethrough of a given diameter, said flowbore having a diameter smaller than the diameter of the rotors and said flowbore including a transitional bore at each end of said member to prevent turbulent flow through the rotors and said member.

7. A coupling for connecting two rotors in a tandem drilling motor, comprising:

a member having a flowbore therethrough for the passage of drilling fluid;

said member being adapted for connection to the rotors whereby drilling fluid may flow through said flowbore and through the two rotors; and reliefs adjacent each end of said member.

8. A coupling for connecting two rotors in a tandem drilling motor, comprising:

a member having a flowbore therethrough for the passage of drilling fluid;

said member being adapted for connection to the rotors whereby drilling fluid may flow through said flowbore and through the two rotors; and tong flats around said member to assist in connecting said member to the rotors.

9. A drilling motor comprising:

first and second stators having first and second apertures, respectively, therethrough;

first and second rotors having first and second bores, respectively, therethrough;

said first rotor disposed within said first aperture and said second rotor disposed within said second aperture;

a housing for connecting said first and second stators and communicating said first and second apertures;

a connector having a flowbore therethrough and having one end connected to said first rotor and a second end connected to said second rotor; and said flowbore communicating said first and second bores.

10. The drilling motor of claim 9 wherein said connector includes transition bores in said flowbore adjacent each end of said connector.

11. The drilling motor of claim 9 wherein said connector includes a threaded pin at said one end and second end and said first and second rotors having threaded box ends for threadingly engaging said threaded pin ends.

12. The drilling motor of claim 9 wherein said connector includes a threaded box at each end and said first and second rotors having threaded pins for threadingly engaging said threaded box ends.

13. The drilling motor of claim 11 wherein said threaded pin and boxes form rotary shoulder connections.

14. The drilling motor of claim 11 wherein said pin includes a base and a nose with said nose having a transition surface received within a transition surface at the base of said boxes.

15. A drilling motor comprising:

first and second stators having first and second apertures, respectively, therethrough;

first and second rotors having first and second bores, respectively, therethrough;

said first rotor disposed within said first aperture and said second rotor disposed within said second aperture;

a housing for connecting said first and second stators and communicating said first and second apertures;

a connector having a flowbore therethrough and having one end connected to said first rotor and a second end connected to said second rotor;

said flowbore communicating with said first and second bores;

said connector including a threaded pin at said one end and second end and said first and second rotors having threaded box ends for threadingly engaging said threaded pin ends;

said pin including a base and a nose with said nose having a transition surface received within a transition surface at the base of said boxes; and a relief between said transition surface and said threaded box in said first and second rotors.

* * * * *